United States Patent [19]

Tipnis

[11] 3,933,480

[45] Jan. 20, 1976

[54] METHOD OF MAKING STAINLESS STEEL HAVING IMPROVED MACHINABILITY

[75] Inventor: Vijayakumar A. Tipnis, Parma, Ohio

[73] Assignee: Republic Steel Corporation, Cleveland, Ohio

[22] Filed: Aug. 12, 1974

[21] Appl. No.: 496,459

Related U.S. Application Data

[62] Division of Ser. No. 289,591, Sept. 18, 1972, Pat. No. 3,846,189.

[52] U.S. Cl. ..... 75/129; 75/57; 75/58; 75/130.5

[51] Int. Cl.[2] ..... C22C 33/00; C21C 7/00

[58] Field of Search ..... 75/57, 58, 53, 129, 135; 148/135

[56] References Cited

UNITED STATES PATENTS

| | | | |
|---|---|---|---|
| 2,576,782 | 11/1951 | Daley | 148/135 |
| 2,799,039 | 9/1961 | Lula | 148/135 |
| 3,235,415 | 2/1966 | Palty | 148/135 |
| 3,301,663 | 1/1967 | Wicher | 75/57 |
| 3,314,782 | 4/1967 | Arnaud | 75/57 |
| 3,459,540 | 8/1969 | Tisdale | 75/129 |
| 3,467,167 | 9/1969 | Mahin | 75/57 |
| 3,723,094 | 3/1973 | Schlatter | 75/53 |

*Primary Examiner*—Peter D. Rosenberg
*Attorney, Agent, or Firm*—Cooper, Dunham, Clark, Griffin & Moran

[57] ABSTRACT

Improved machinability of stainless steels, as determined by production-type operation of automatic screw machines, is obtained: by providing globular inclusions in the steel, which comprise essentially sulfur and selenium or tellurium, in combination with manganese, and which maintain globular character through extensive reduction as by hot rolling, the proportions of such elements being controlled to produce the inclusions, very preferably with a specific, relatively low and economical addition of selenium or tellurium; and also by controlling the actual presence of aluminum oxide in the steel, including the control of deoxidation practice, to provide production of stainless steel having not more than a critically very low content of aluminum oxide. In martensitic grades, the improved stainless steels are further enhanced in machinability, e.g. as to chip characteristics, by special heat treatment, including heating between the $A_1$ and $A_3$ critical points of temperature. Optional additions of rare earth elements can coact in establishing or enhancing the desired, e.g. sulfide-selenide, inclusions, and can afford deoxidation function effective in avoiding unwanted aluminum addition, for corresponding cooperation in minimizing occurrence of aluminum oxide.

10 Claims, 13 Drawing Figures

Fig. 1.
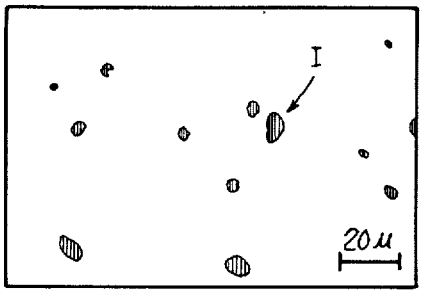
Fig. 2.
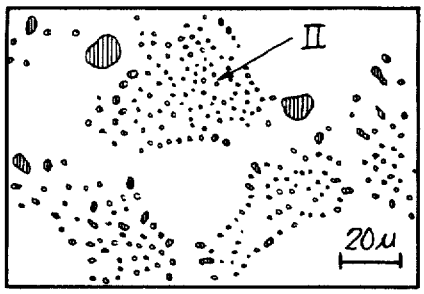
Fig. 4.
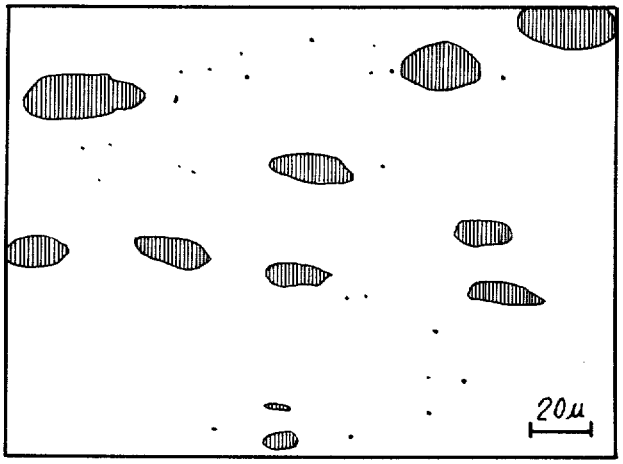
Fig. 3.
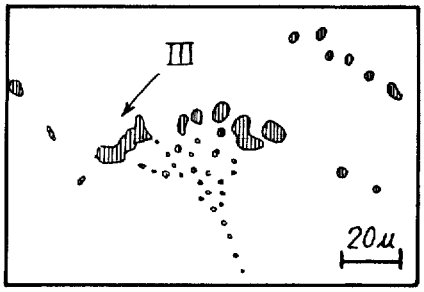
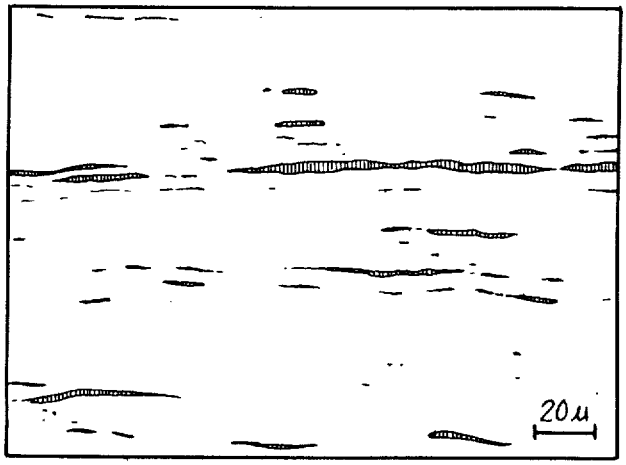
Fig. 5.

METHOD OF MAKING STAINLESS STEEL HAVING IMPROVED MACHINABILITY

This is a division of application Ser. No. 289,591 filed Sept. 18, 1972, now U.S. Pat. No. 3,846,189.

BACKGROUND OF THE INVENTION

This invention relates to stainless steel and is more particularly directed to the provision of stainless Steels having superior machinability, and to methods of producing such steels.

Although much work has been done toward the development of so-called free-machining stainless steel, and although steels so classified have been marketed with some success for a number of years, the machining properties have tended to fall short of those attainable in plain carbon steels designed for good machinability, and there appears to have been a failure of understanding or full appreciation of the nature of the problems presented by stainless steel in this area. Indeed, requirements and conditions can be considered more critical than in the low or medium carbon grades of ordinary steel, in that: machined products of stainless steel, which is more costly, are often expected to have a much better finish and dimensional control than carbon steel products, while secondary operations such as reaming, threading, tapping and grinding on stainless grades can be very uneconomical at high volumes of production, as in shops using automatic screw machines; and stainless steels are inherently unsatisfactory to machine not only because of general cutting difficulties but especially because their thermal diffusivity is about two-thirds to one-half that of plain carbon steel, causing higher tool chip temperature and consequently shorter tool life.

Particular stainless steels that have heretofore been produced with special characteristics of machinability include AISI type 303 of the austenitic 300 series, and AISI type 416 from the martensitic grades of the 400 series, as well as others, e.g. the ferritic type 430F. Although the principles of the present invention are primarily illustrated with the so-called free-machining varieties such as the 303 and 416 stainless steels, the same principles are deemed applicable to a broad range of stainless steels. embracing the 200, 300 and 400 series, and also the precipitation hardening grades of both the martensitic and semiaustenitic types, such broader range being inclusive of steels for which the end service properties might restrict the usages of free-machining additive to low levels. As explained below, the invention has been developed with special applicability to the presently recognized machining grades, for example types 303 and 416, and corresponding particular objects are to provide improvement in such grades, notably in suiting the properties of these steels to the requirements of machining operations in industrial production.

It has been known that the addition or intentional inclusion of one or more elements such as sulfur, selenium, tellurium, lead and bismuth can be beneficial to machining properties in essentially all kinds of steel, and such additions of sulfur or selenium, for instance, in the amounts Of 0.15% or more have been employed in stainless types 303, 416 and 430F to provide the basis for rating such types as machinable. In a produced steel sulfur additions usually appear as sulfide inclusions, basically as manganese sulfide and these inclusions can exhibit a variety of morphology and may contain one or more other elements, such as the so-called transition elements, dissolved therein, all depending on a variety of compositional and processing factors that have not heretofore been fully elucidated.

Various and not entirely consistent views have been expressed as to the circumstances for enhancement of machinability by the use of sulfur or for assurance of a suposedly effective kind of inclusion. Thus for example, some investigators have proposed, chiefly on the basis of the ratio of manganese to sulfur in the steel (i.e., between the total amounts of these elements, in weight percent), that improvement in machinability of stainless steels can be effected by reliance on a supposedly proper range of Mn to S ratios alone. In other cases, one or another of various considerations, chiefly of the nature of specific additions or omissions of chemistry, have been asserted to be useful, but the extended investigations upon which the present invention is predicated have revealed that there has heretofore been a failure to understand or recognize many underlying factors, bearing on the nature and effectiveness of sulfide inclusions, or what inclusions are truly suitable for achieving machinability or how they can be achieved, notably in production type quantities of steel, or what may be the effect or significance of steelmaking processes on machinability and on additions supposed to improve it.

It appears, moreover, that past studies have in general failed to take proper account of various requirements of machinability, particularly the needs of industry in making machined articles from stainless steel. Thus in some cases sole reliance has been placed on limited drilling tests, such for example as in measuring the time required for a given penetration by a specified drill under a constant load, but these determinations have given little or no indication of performance in regard to surface finish, tool wear, tool life, or chip characteristics, or indeed in practical productivity, e.g. the speeds and feeds that can be used in production machinery. Attention has, of course, been given to one or another of these factors in other discussions of free machining steel, but their collective significance has not been emphasized. More importantly, in the testing or design of new steel compositions there appears to have been essentially no recognition, and certainly no report of systematic use, of production-type studies such as involve, for instance, a continuous run of several hours of an automatic screw maching producing 1,000 to 1,500 or more pieces of the test steel, each subjected to a machining cycle which includes major machining operations that reveal the performance factors mentioned above and which is representative of the kind of work required by industrial users.

Definitive information on essentially all factors of machining performance is obtainable with production-simulating tests of this sort, but they can be usefully supplemented or extended by specific single-purpose tests of rigorous design, such as turning tests for tool life and tool wear, plunge cutting for surface finish determinations, and drilling tests using suitably large drills for chip breakability determinations. Investigation has indicated that selection of compositional ranges and other characteristics to provide supposedly machinable steels, based only on one or a few limited tests such as drillability used by many of the previous investigators, can be very unreliable, and in particular do not afford good correlation with true and complete requirements for machining stainless steel, i.e., requirements as outlined above that must be met in industrial practice.

Accordingly, important aims of the present invention are to afford improved stainless steels, and methods of producing them, which have distinctly superior machining properties and which in presently preferred embodiments are well suited to the needs, in quality and production rate, of manufacturers of machined products. A further object is to provide such steels and such methods in an economical manner, and without significatntly altering the other desired properties that characterize the grade of steel to which the invention is applied.

SUMMARY OF THE INVENTION

To the above and other ends, important aspects of the invention reside in the discovery that superior machining properties in stainless steels are not only dependent on the presence of inclusions which are of the general nature of those heretofore classed as manganese sulfide inclusions and which are of a so-called globular type, but are also dependent on the volume fraction and the shape, distributional, compositional and mechanical characteristics of such inclusions, and on the existence of these characteristics after the steel has been carried through the usual production operations such as hot rolling. These requirements cannot be assured, and indeed usually fail to be realized, in reliance simply upon a factor such as a so-called manganese-sulfur ratio, determined as the proportion of total manganese to total sulfur in the steel. On the contrary, it is important that the inclusions be present in such kind, amount and size as has been discovered to be correlated with the more complete and significant tests of machinability explained above, and as has specifically been discovered to involve further or additional compositional and processing factors, not heretofore recognized.

Thus a significant feature of the invention, in its specific and preferred aspects, resides in the finding that instead of relying on sulfur as the sole addition to promote machining properties, improved characteristics of the inclusions are attained by incorporation of selenium, or in some cases alternatively or additionally by the incorporation of tellurium. Particular advantage, directly related to improvement in tool life and surface finish in machining, is provided by compositions containing both sulfur and selenium, where the selenium is present in amounts that may be significantly and very desirably less than the quantities usually specified, e.g. in AISI types 303 Se, 416 Se and 430F Se, for attainment of free machining. Specifically compositions which thus contain sulfur, and selenium in amounts less than 0.15%, preferably 0.04 to 0.1%, together with manganese in sufficient amounts to satisfy the theoretical stoichiometric requirements of MnS and MnSe as well as to account at least for other unavoidable or required utilization of manganese in the steel (such as consituting a mild deoxidizer and a matrix strengthener), are found to provide inclusions of superior and assured characteristics for machinability, not heretofore or reliably achieved with inclusions predicated on sulfur addition alone. At the same time, the steel is relatively economical to produce, for example as compared with the special grades last mentioned or as measured, in effects, against the attained improvement in machinability.

Further features of the invention are based on the finding that aluminum, even in amounts heretofore considered inconsequential, as for example the small quantities conventionally used for deoxidizing (i.e., killing), and indeed even in smaller amounts that would ordinarily be deemed incidental, may lead to detriment in machinability, specifically to the extent that the aluminum becomes or appears as aluminum oxide, i.e., alumina, $Al_2O_3$. Extended studies involving analysis of steels for aluminum oxide content, which is not ordinarily determined or which is ordinarily considered of no consequence at the levels so studied, have revealed that tool wear and tool life in machining are very sensitive to aluminum oxide in the steel; for example, whereas an ordinary commercially produced, free machining grade 416 may show 0.006% or more of $Al_2O_3$, i.e., an amount not usually deemed consequential or even commonly measured, limitation of such oxide content to 0.002% and below has afforded large increases in useful tool life, of the order of 50% to 100% or more. The aluminum oxide appears as a distribution of minute, hard particles or inclusions, further evidence being that they tend to show up in manganese-sulfur inclusions and apparently even influence the very nature of precipitation of the latter in an adverse manner, as by promoting so-called eutectic or type II sulfides which become long, stringy configurations of the manganese-sulfur bodies in as-rolled steel bars.

Thus the invention, in one related aspect, consists in steel of the stated character wherein alumina is kept to an unusually low maximum, such as 0.0025% or more advantageously 0.002%, and is preferably well below such values, a further feature being that the process of making the steel involves deoxidation otherwise than by the use of aluminum, as for instance by employing silicon (conveniently in the form of ferro-silicon), and indeed more specifically by using such agent in a form having no more than a very low impurity content of aluminum. Another aspect of the invention is that the incorporation of selenium along with sulfur, in the manner explained above, has been demonstrated to reduce materially the tool-destructive effect of aluminum oxide, it being further noted that at moderately small levels of $Al_2O_3$ (yet above 0.002%) the manganese-sulfur-selenium inclusions retain their desired substantially globular shape and appearance, and have been observed as functioning, at least in part, to provide a sheath or enclosure for the aluminum oxide particles.

As a supplemental feature of the invention, constituting an addition or in part alternative to manganese for the composition of the sulfide-selenide inclusions, rare earth metals such as lanthanum, cerium and others may be employed, with good effect on the machinability of the steel in one or more of the respects of tool life, surface finish, ease of chip removal, and productivity. These elements can form sulfides and selenides, or possibly complex compounds of such nature with manganese, and produce the desired globular inclusions or appear in them, imparting characteristics that are similar to those afforded by compounds of manganese with sulfur or selenium. A further procedural feature is afforded by the step of adding a rare earth metal or metals, as at the end of a heat or in the ladle, in that such addition may serve the deoxidizing function in lieu of silicon or other substitute for aluminum, and then at least in part the rare earth addition may appear as sulfide or selenide compounds in the inclusions or some of them, promoting formation of such inclusions in the desired manner. Such results are attainable, for example, by adding two to three pounds per ton, of a rare earth alloy of common type, containing predominantly lanthanum and cerium, with minor proportions of others.

It has also been found that martensitic grades of stainless steel produced to contain the desired, unusually effective inclusions, e.g. comprising manganese with sulfur and selenium, may be further benefited by a special heat treatment, particularly in that the chip formation, for various kinds of machining operations, can be greatly improved. That is to say, in some cases even with optimum form and volume fraction of the sulfide-type inclusions, machining chips may in fact be very long, tough ribbons or curls of difficultly manageable type. In accordance with this further feature of the invention the improved steel, as for instance of the 416 grade, is subjected to heat treatment which includes heating to a temperature between the lower and upper critical points, i.e., between the $A_1$ and $A_3$ temperature for the given composition, holding the piece at the temperature in an inert atmosphere furnace for 1½ hours or more, depending on the diameter of the bar or other shape, and then cooling in air to room temperature. If desired, the article can thereafter be tempered at a suitable, lower temperature, and also stress-relieved. In circumstances where the cutting or drilling chips may tend to be several feet long without this treatment, its effect is to cause the chips to break off short, e.g. at a few inches or less. It is believed that the treatment, notably if performed in a preferred manner as explained hereinbelow, results in a two-phase microstructure, partly martensitic and partly ferritic with carbides.

The effect of practice of the invention in one or more of its aspects, and preferably in respect to the controlled addition of selenium in coaction with the essentially complete elimination of alumina, for attainment of optimum nature and properties of the described inclusions, including the distinct and critically advantageous characteristic that such inclusions are not materially altered in their globular or ellipsoidal shape, or in particular, flattened to long, thin configurations, by hot rolling, has been to achieve improvement of a very practical sort in the machining properties of stainless steels. These and other advanntages of the invention, and additional disclosure and explanation of various compositional and procedural features thereof, are also set forth or will become further apparent in the following detailed description, including reference to specific heats and practices by way of example.

BRIEF DESCRIPTION OF THE DRAWINGS

FIGS. 1, 2 and 3 are microphotographic views respectively showing three different types of sulfide inclusions in steel.

FIG. 4 is a microphotographic view showing inclusions, of the general type of FIG. 1, as appearing in a stainless steel embodying the invention.

FIG. 5 is a view, to be compared with FIG. 4, showing undesirable sulfide inclusions.

DETAILED DESCRIPTION

Figure 6:
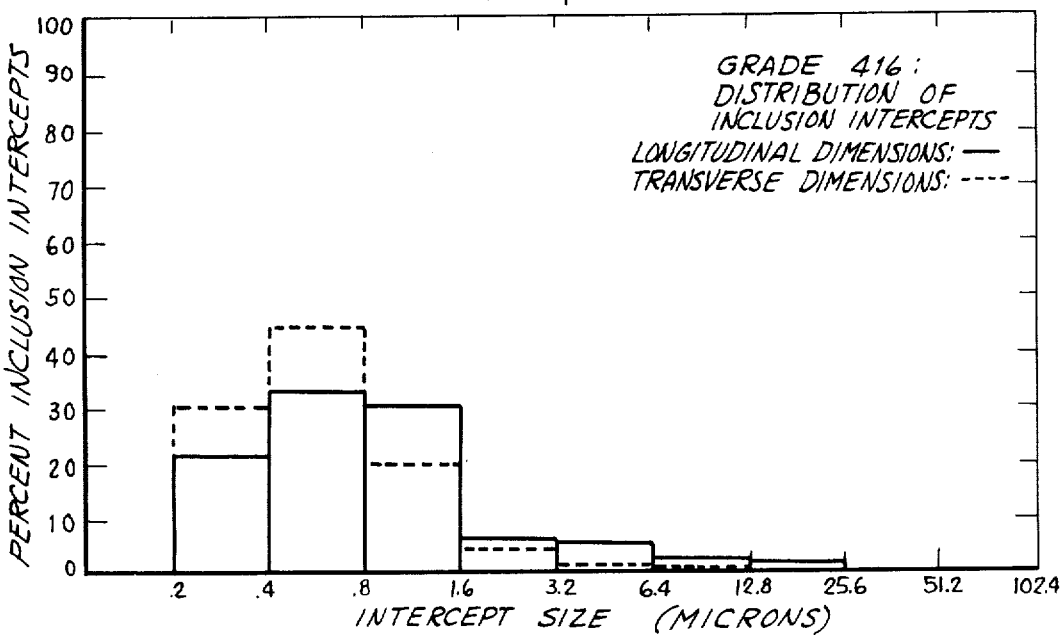
FIG. 6 is a graph illustrating the distribution of plane intercept dimensions corresponding to distribution of inclusions in an example of one type of stainless steel embodying the invention.

As indicated, the investigations leading to the present invention and the evaluations of stated results were largely based on production-type tests of long duration. Specifically, each test consisted of an 8-hour run on an automatic screw machine, supplied with 1-inch diameter bars and automatically turning out small finished pieces, usually a total of 1,500 to 1,700 pieces for the 8-hour run. The general practice in preparing the test bars involved hot rolling from 4-inch billets, followed by a small amount of cold reduction (when the special heat treatment of the present invention was used, it was performed after the cold reduction), the bar being thereafter turned and ground, in other equipment, to have the finished 1-inch dimension. Utilizing a 6-spindle automatic screw machine, it was charged with six bars, each 12 feet long, and in general each 8-hour run required three to four further charges depending on the cutting speed and feed chosen for the test.

Various combinations of machining operations, generally using standard, hardened, high speed steel tools, were performed on each piece, a typical setup involving rough forming, finish forming, facing, three drilling operations, reaming, and cut-off. In some instances additional or alternative finish machining operations were used, such as shaving, thread cutting and double reaming. The machined pieces were cut off at about 1½ inch lengths. Runs of this sort permitted evaluation of numerous aspects of machining practice, with respect to the particular stainless steel under test, i.e., the selected heat from which the prepared stock of 1-inch bars was obtained.

A notably important measurement was with respect to surface finish, i.e., on the outside surface of revolution of the test pieces, resulting from the finish forming step. This surface finish measurement was made with a Brush surface analyzer, yielding a roughness determination, corresponding to the wave height or peaks of surface roughness. As will be understood, the measurement was thus determined, conventionally, as microinch R.M.S. (root-mean-square), one minimum criterion being to achieve a surface roughness less than 100 microinches R.M.S. over a tool life of at least the stated 8 hours at a chosen combination of feed and cutting speed. The cutting speed, as will also be understood, represented the relative speed of the surface of the work, i.e., in the circumferential direction, past the cutting tool; for machining grades such as 303 and 416 the selected speed was 150 surface feet per minute or higher. The end slide feed of the machine (i.e., the drill feed) was also maintained at a desirable production value, for instance of the order of 0.005 inches per revolution for grades 303 and 416 and the like. The cross sldie feed was about one-seventh of the end slide feed. The finish forming operation was usually a plunge cut, employing a tool of appropriate width moved radially inward of the workpiece and thereby producing an annular machined area which has a width equal to that of the tool and is intended to be characterized by a finished surface.

At regular intervals, finished pieces were removed for surface measurement and other examination. Standardized practice involved taking six pieces at every 100-piece interval and examining each with a surface analyzer. Determinations were plotted, against duration of the test, by taking an average of the surface roughness for each set of six pieces, and also delineating the range of variation among the six. In general, a single tool was allowed to remain in place, without sharpening, throughout the entire 8-hour run. In such operation, the gradual rise in surface roughness and the increase in the diameter at the finish form station, over the entire run, afforded in indication of surface deterioration and tool wear. For special purposes, examinations and tests of other surfaces or cuts, as resulting from the other operations, including facing, drilling and reaming, were made. It will be understood that in instances where tool wear became excessive or the machining operation involved premature destruction of the tool, the test was terminated short of the total 8 hours. Oil coolant was employed in the operations, and chip characteristics were also noted.

These 8-hour screw machine tests, as by comparisons utilizing standard types of stainless and other steels, were found to have good correlation with the experience of several industrial screw machine shops engaged in actual production, because the described test was specially designed to reproduce all the important features of screw machine operation. As will now be appreciated, the data from each 8-hour test thus represented a significant formulation of actual production-type machining.

By way of supplement to the screw machine tests, and for a number of areas where comparative determinations of a simpler nature were appropriate, various shorter or expedited tests were employed. One such was a single point turning test, involving a high speed surface cut (i.e., a helical cut) on a standard piece, for example a 4-inch diameter round bar, utilizing a hardened, high speed steel tool and a continuous run until destruction of the tool occurred. During the test no cutting fluid was used. It was found that with surface speeds of 200 surface feet per minute and upwards (suitable selection being made for each test), 1 second of tool life in this operation corresponded to approximately 1 minute of run of an automatic screw machine functioning as outlined above, because high speed tools, i.e., tools of the same type were used in both tests. As indicated, these special tests afforded a reliable indication of tool life.

For further introduction to the invention, reference is made to FIGS. 1, 2 and 3 of the drawing, being microphotographs at about 500x magnification, showing the three generally recognized types of manganese sulfide inclusions in steel. The first are the so-called globular inclusions, being Type I as in FIG. 1. These are round or somewhat elongated bodies predominantly composed of a compound of manganese and sulfur and it has now been demonstrated not only that they are requisite for providing enhanced machinability by reason of sulfur addition, but also that they must persist in the final product form of the steel, e.g. after hot rolling or like reduction. In such rolled products these inclusions, as retained in useful state, are actually of an ellipsoidal shape for the most part, but the term "globular" will be more generally employed herein, being thus understood to include the ellipsoidal or otherwise somewhat elongated forms.

Another type of inclusion, shown in FIG. 2 and identified as Type II, usually consists of much smaller particles, often appearing along grain boundaries or in groups defined by such boundaries, these being sometimes called eutectic inclusions. In other cases, or particularly as a result of reduction by rolling, these Type II inclusions appear as long, thin or stringy bodies, but it has been determined that whichever their shape, these Type II inclusions are relatively undesirable and do not have the capability of improving machining properties in the manner of the globular type. It is believed, as indicated by studies, that where circumstances favor the formation of Type I inclusions, the latter are produced by segregation of manganese and sulfur in combination, usually throughout the steel and in approximately uniform though perhaps localy random distribution, at a stage prior to the completion of solidification of the cast ingot. Type II inclusions are understood to be formed or precipitated only on the freezing of that liquid phase or portion of the steel which solidifies last, this stage being very rapid so as not to afford time, as is the case in the formation of the globular (Type I) bodies, for migration or diffusion of manganese sulfide or its constituents into collected, larger masses.

Type III inclusions are illustrated in FIG. 3, being somewhat large, highly angular bodies of corresponding irregular shape and often having a highly irregular distribution in the steel. They seem, at least in part, to be of the nature of individual crystals or shapes of crystal growth. Inclusions of this sort have also been found to be relatively ineffectual, especially because inclusions of this type or form occur, as has now been discovered, when the steel is excessively deoxidized with aluminum, with the resultant formation of undesirable $Al_2O_3$.

As will be understood, more than one type of inclusion can show up in a given steel; for example, some Type I inclusions may be formed even though the Type II particles are plentiful or greatly predominant, or there may be a number of Type III bodies. Likewise, Type II groups may accompany inclusions of Type III, e.g. as in FIG. 3. For indication of the general order of size of the inclusion bodies, a scale designation of 20 microns has been added to each of the above microphotographic representations, although it should be understood that the globular inclusions, for instance, may have a considerable range of dimensions, including sizes well above those seen in FIG. 1.

In the investigations leading to the present invention, it was effectively determined that superior results in machining, notably as to surface finish, tool life and availablility of suitably high speeds of cutting, required a reasonably uniform distribution through the steel of the globular-type inclusions, with essentially little or no presence of other types. Correlation between machining results and inclusion characteristics was found to be very close, and in accordance with the invention, desired results were further determined to be dependent on significant factors, including compositional factors both as to the inclusions and as to the steel, other than the presence of sufficient sulfur and attainment of manganese-sulfur ratios within ranges of the nature heretofore indicated.

Thus for example, in a stainless steel of the 416 grade, containing 13% chromium and other compositional characteristics as prescribed by standard specifications (including sulfur in the range upwards of 0.15%), measurement of machining tool life for various manganese-sulfur ratios showed a minimum value to be requisite but also showed that values substantially higher yielded progressively shorter tool life. In this preliminary investigation, it was noted that a peak of useful tool life lay between about 2.5 and 4.5 for the stated ratios. A 416 grade steel having a manganese-sulfur ratio of only about 1.5 was relatively poor, whereas a heat with the ratio at 3.35 showed much more satisfactory results, e.g. a severalfold greater tool life, and surface roughness (in an 8-hour test) at about one-half the value for the steel with the lower ratio. Moreover, microprobe examinantion revealed a significant chromium content in the inclusions of the low-ratio metal, which was essentially absent in the higher-ratio material.

As indicated above, it was found that the inclusion of selenium in the steel produced an unusually marked improvement in all of the machining properties, and was shown to promote and maintain the desired distribution of gloular inclusions, indeed with little or no sensitivity to manganese-sulfur ratios, so long as the manganese was sufficient to accommodate all of the sulfur present and likewise all of the selenium. In general, this was found to involve a ratio between manganese and sulfur plus selenium, of over 2, usually about 2.5 or more, it being noted that the quantity, as by weight, of manganese, needed to combine with the selenium is proportionately less than in the case of sulfur.

Specifically, for both the 416 and 303 grades, containing sulfur upwards of 0.15%, it was found significant to include selenium in the range of about 0.04%, preferably 0.05%, and upwards, but generally less than 0.15%, a preferred range being up to about 0.1%. While in a broader sense, larger amounts of selenium can be accommodated and are conceivably useful, there is special advantage in utilizing the lower range which has now been found to be very effective. That is to say, amounts of selenium of the order of 0.2% and above are relatively uneconomical to add, not only because of the cost of this element but also because losses by vaporization from the melt increase, proportionately, at a much greater rate than increases in the concentration which is to be established.

For example, to keep 0.1% Se in the steel, it usually suffices to supply about 0.12% (by addition in the ladle), whereas to reach a level of 0.2% can well require supplying more than 0.3% of this element, even up to 0.4%, with still greater proportions of loss at higher levels.

The addition of selenium was specifically noted to provide improvement and stabilization of the desired globular inclusions, to the extent of permitting their effective presence regardless of the existence of even relatively high manganese-sulfur ratios and regardless of other influences deleterious to the desired form and shape of the inclusions.

An extremely important characteristic of the selenium-sulfur inclusions is that they substantially retain their globular, i.e., ellipsoidal shape through conventional forming steps (e.g. hot rolling and cold reduction) intermediate between the casting of the ingot and ultimate production of a bar or the like, this being particularly true with respect to hot rolling. Whereas ordinary manganese sulfide inclusions, even when globular in the as-cast metal, are sensitive to conversion to a long, thin, stringy configuration as a result of hot rolling, the sulfur-selenium inclusions of the present invention have been formed to retain their shape, i.e., by virtue of sufficient hardness at the rolling temperatures of the order of 1,800°F. and higher, so that they are still desirably globular in the ultimate bar or other stock.

Specifically, it has been discovered that the Mn(S, Se) globular inclusions, here described, are significantly harder than Mn(S) inclusions at the hot working temperatures, to the critical extent that they keep their characteristics and change only to an ellipsoidal or moderately elongated form, whereas the Mn(S) inclusions are at least in most cases changed by hot rolling to a thin, highly drawn-out, inferior type. Indeed, it has also been noted, on the other hand, that Mn(S) bodies, even when of suitable configuration, are relatively harder and correspondingly less appropriate than the present Mn(S, Se) inclusions, at the temperatures of 1,000°F. or thereabout, reached locally in the metal by the action of the tool in machining.

These facts, including particularly the effects of hot rolling on the inclusions and the correlation between type of inclusion and machinability have been well established by test, and conclusively so by product-type machining tests as described above. Significant improvement in tool wear and tool life, surface finish, and other factors investigated under practical working conditions, has been attained with the stainless steel having Mn(S,Se) inclusions according to this invention, as contrasted with such steel as the standard sulfur-containing 416 type with manganese content up to and beyond several times the sulfur level. As noted, these comparisons were made between steels produced in the regular manner and with the usual hot rolling reduction. Conventional practice in making bar or similar stock includes extensive hot reduction, through the stages of slab and billet to or almost to the final bar section, the total of such reduction in thickness being at least 90%, and often more. The avoidance, in the present products, of deterioration due to hot rolling is well exhibited (in comparison with the prior sulfur-containing types mentioned above) in all situations where there has been substantial hot rolling, for instance to 50% reduction or more.

By way of example, the following represent the compositions of typical heats of the 416 and 303 types of stainless steel embodying the invention, the values being weight percent, as is true for all percentages elsewhere herein except when otherwise specified, and the balance being, of course, iron except for incidental impurities:

| Type No. | C | Mn | P | S | Si | Ni | Cr | Mo | Se | $Al_2O_3$ |
|---|---|---|---|---|---|---|---|---|---|---|
| 416 | | | | | | | | | | |
| Heat A | 0.112 | 1.14 | 0.018 | 0.349 | 0.39 | 0.37 | 13.05 | 0.11 | 0.05-0.1 | <0.002 |
| Heat B | 0.127 | 1.08 | 0.027 | 0.290 | 0.34 | 0.33 | 13.00 | 0.21 | 0.05-0.1 | <0.002 |
| 303 | | | | | | | | | | |
| Heat A | 0.071 | 1.72 | 0.043 | 0.224 | 0.49 | 9.35 | 17.50 | 0.65 | 0.05-0.1 | <0.002 |
| Heat B | 0.090 | 1.69 | 0.033 | 0.326 | 0.64 | 9.39 | 17.25 | 0.37 | 0.05-0.1 | <0.002 |

Each of the above was a 70-ton heat, made in an electric furnace in a generally conventional manner and likewise conventionally processed with extensive hot working, i.e., hot rolling to a high percent of total reduction as explained above, whereby the ingot form was converted to the eventual product shape, such as round bars. Exceptions to conventional practice included, of course, the novel compositional characteristics. Additions were made in appropriate manner, as for example that manganese was added as ferro-manganese. Selenium, conveniently in form of ferro-selenium, was added to the melt in the ladle, as likewise elemental sulfur in amount necessary to reach a desired total above 0.2%, i.e., in the range up to 0.4%, with some preference for values around 0.3%. The steel-making operation also included specific control of the content of aluminum oxide, as measured in the final ingot or billet, with the aid of special deoxidation practice in accordance with another feature of the invention as explained elsewhere herein.

These steels were found to exhibit superior machining properties, e.g. by the screw machine tests, and to provide, for example, turning capability with good surface speeds, at useful tool life upwards of 8 hours and with surface finishes having a roughness below 50 microinches R.M.S., such speeds being about 200 surface feet per minute for grade 416 and at least about 150 for grade 303.

Numerous tests have further shown that the volume fraction of the globular inclusions in the steel is important, especially for the so-called free-machining grades, and, of course, is dependent on the proportions of manganese, sulfur and selenium in the compositions. For effective realization of the benefits of the invention, the manganese content of the steel (weight percent) should in most cases be equal to or greater than the value of 2.5 times (often at least 3 times) the sulfur content, or advantageously, such value plus that of the total content of element or elements of the class consisting of selenium and tellurium. Under such circumstances and with sufficient selenium and/or tellurium as elsewhere herein explained, the inclusions or segregated bodies containing elements S, Se and/or Te are predominantly and usually substantially all of globular type, provided by manganese in coaction with such elements, and indeed at least predominantly characterized by the presence of quantitites of such elements in combination with manganese, the inclusions also being predominantly free of unwanted elements such as chromium. As also explained herein, tellurium functions similarly to selenium and may in at least a number of instances be employed wholly or partially as an alternative, although selenium is presently deemed to be of special advantage, economically and otherwise, and is therefore chiefly considered in the exemplification of the invention.

In general, the volume fraction, which is the ratio of the total volume of inclusions to the total volume of metal, measured in percent, may range from 0.1% to an upper convenient limit of about 4%. The optimum or ordinarily desired values differ for various grades or types of stainless steel, and depend on whether the steel is specially designed for machinability or whether the invention is employed as a supplemental improvement of machinability in steels where other characteristics are paramount. The obtainable volume fraction of inclusions for a given content of S, Se and/or Te has been measured as lower for austenitic steel than for martensitic compositions, and the cause of this difference, e.g. possibly a result of the microstructure or perhaps an inability to measure the very finest iclusions, is not known, but it is believed that in general the content of S, Se and/or Te, aat least substantially (e.g. one-half or more) or doubtless predominantly, becomes embodied in useful inclusions.

For the free-machining type 303, which is a chromium-nickel austenitic grade, a volume fraction of 0.3% to 1.5% has been found very suitable, the range of about 1% and above being especially preferred. In the above examples A and B of such steel, the volume fractions were about 0.9 and 1.1%. Likewise in the straight-chromium, martensitic, free-machining grade 416, best results have been achieved with a volume fraction of 0.9% to 2.5%, present special preference being for values in the range approaching 2% and upwards. In the stated examples A and B of 416, the volume fractions were about 1.8 and 1.5%. These best and preferred ranges for austenitic and martensitic grades are believed to be applicable in general to other so-called free-machining stainless steels, respectively as some may be of austenitic or martensitic character; more generally, in stainless steels designed to have high machinability, including ferritic grades of the 400 series and precipitation-hardening grades, useful results are achieved in the range of volume fraction, for inclusions, from 0.3 to 4%, preferably 1 to 2% as may be readily ascertained (by test if necessary) for any given composition of such steel.

In the case of stainless grades not ordinarily to be classed as free-machining, of which examples are given hereinbelow and for which high sulfur levels (e.g. even 0.1%) cannot be tolerated in view of requirements for corrsoion resistance or otherwise, the improvements herein described are applicable for achieving some useful betterment in machinability, as at least to aid in some necessary drilling, cutting or shaping operations. In such cases, the volume fraction of the inclusions may have to be relatively low, i.e., about 0.1 to 0.2%, but may be higher if possible.

A special requisite of superior machinability in accordance with the present invention is the control of the inclusions to have the desired globular shape, this being primarily achieved by the stated incorporation of selenium (or tellurium) in the range upwards of 0.01% and for the special machining grades, preferably upwards of 0.04%. The selenium (or tellurium) content should, moreover, ordinarily be equal in amount to at least one-tenth of the sulfur; a range of one-half to one-eighth has been usefully employed in the special machining types with sulfur around 0.2% and above, but providing, of course, that a minimum absolute amount of this element, e.g. selenium, is present. Higher relative proportions of selenium are ordinarily requisite in stainless steel grades with very low sulfur, e.g. 0.03% S max.; with 0.01 to 0.03% Se, the latter may equal from one-half to twice or more of the sulfur content.

Reference is now made to FIGS. 4 and 5 of the drawings, the first of these being a microphotographic showing of inclusions of the globular (specifically, ellipsoidal) character which are found in steels of the invention, such as the 303 and 416 examples noted above. In contrast, FIG. 5 shows long, thin inclusions which, as explained above, are undesirable and which are found, for example, in a 416 grade steel lacking selenium and processed, through hot rolling, from a heat having a manganese-sulfur ratio of about 3. Examination of a number of heats made in accordance with the invention have indicated that the inclusions (in the final product, after hot working) are at least predominantly, preferably very predominantly, Type I as shown in FIG. 4, it being understood that advantageously 80% or more of the total inclusion volume, and most usefully over 90%, is in this form. The long thin inclusions, of prior products, such as in FIG. 5, appear to have a ratio of length to diameter of more than 10, often well over 10, whereas such ratio for the globular type of bodies is usually substantially smaller, being predominantly (and preferably nearly all) 5 or less, with notably good results where their length-to-diameter ratios are predominantly no more than 3, or even 2.

Figure 7:
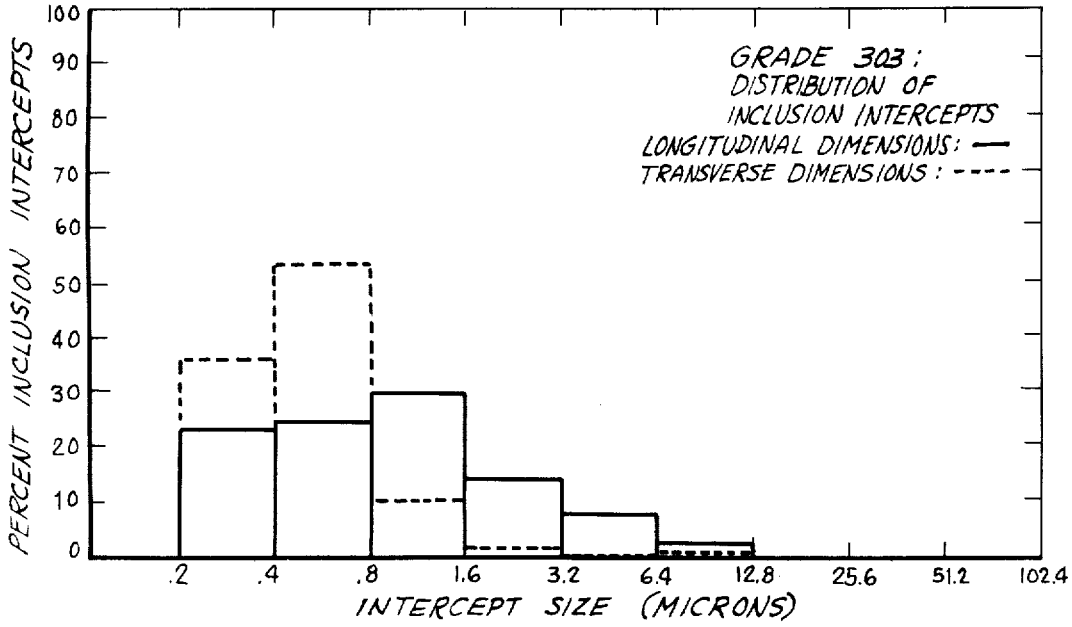
FIG. 7 is a graph, like FIG. 6, showing such intercept-dimension distribution for another type of stainless steel of the invention.

Turning now to FIGS. 6 and 7, these bar graphs afford some information about the examples of 303 and 416 grades made in accordance with the invention, e.g. as above. These are computer-plotted graphs of information derived, by sensitive scanning instrument, from sections through the steels, and represent the size distribution of transverse and longitudinal dimensions of the measured intercepts of the inclusions. Since the intercepts or sections of the ellipsoidal inclusions will often or perhaps mostly occur at other than central localities, the measured dimensions have average values considerably smaller than those of the actual inclusions, which are believed to predominate, roughly, in a length range of 2 to 20 or 30 microns (with instances up to 50 or even 80), but the plotted data are deemed of some significance in a relative sense, e.g. for comparison with readings of other specimens made on intercepts in the same way. Moreover, the graphs exclude measurements less than 0.2 micron, as being below the reliable range of the measuring instrument, but it is likely that the curves would slope down to low values in such regions.

In each graph, the broken lines represent the transverse (narrower) dimensions and the solid lines, i.e., horizontal, represent the longitudinal dimensions or length of the inclusion intercepts. Thus for example in FIG. 6 (grade 416) about 45% of the measured inclusion-section widths (transverse) were between 0.4 and 0.8 micron, and about 33% of the measured lengths were in the same range; other particulars of size distribution for the intercepts are similarly readable in FIG. 6, and likewise in FIG. 7 for one example of grade 303. As stated, all this relates to the size of the inclusion sections that were intercepted, rather than to the actual inclusion sizes, which were much larger.

A further feature of the invention, embodied in the examples of stainless steel set forth above, and in their method of production, embraces the control of such production, including special aspects of the treatment of the metal, so as to afford an output of produced steel wherein the content of aluminum oxide is reduced to and maintained at an extremely low value. In preliminary examination of free-machining steels, for example of the 416 grade, it was noted upon certain tool life tests that a marked difference in tool life existed between various heats, despite little or no compositional variation or processing difference of ordinarily recognized sort. It was discovered, upon extended further tests, including accurate chemical analysis of the steels for alumina (determined as acid-insoluble aluminum), that such aluminum oxide was a significant factor in tool wear and tool life. Indeed, despite that fact that instead of killing (deoxidizing) the steel with the usual addition of aluminum, tests were run where the steel (otherwise embodying the invention, as to inclusions) was deoxidized with silicon (supplied as ferrosilicon), considerable difficulty still persisted. When drastic effort, however, was thereafter made to avoid the addition of any appreciable aluminum in the killing step, specifically by using ferrosilicon of extremely low aluminum content, a very marked improvement in tool life could be achieved quite consistently in the produced steel.

Figure 11:
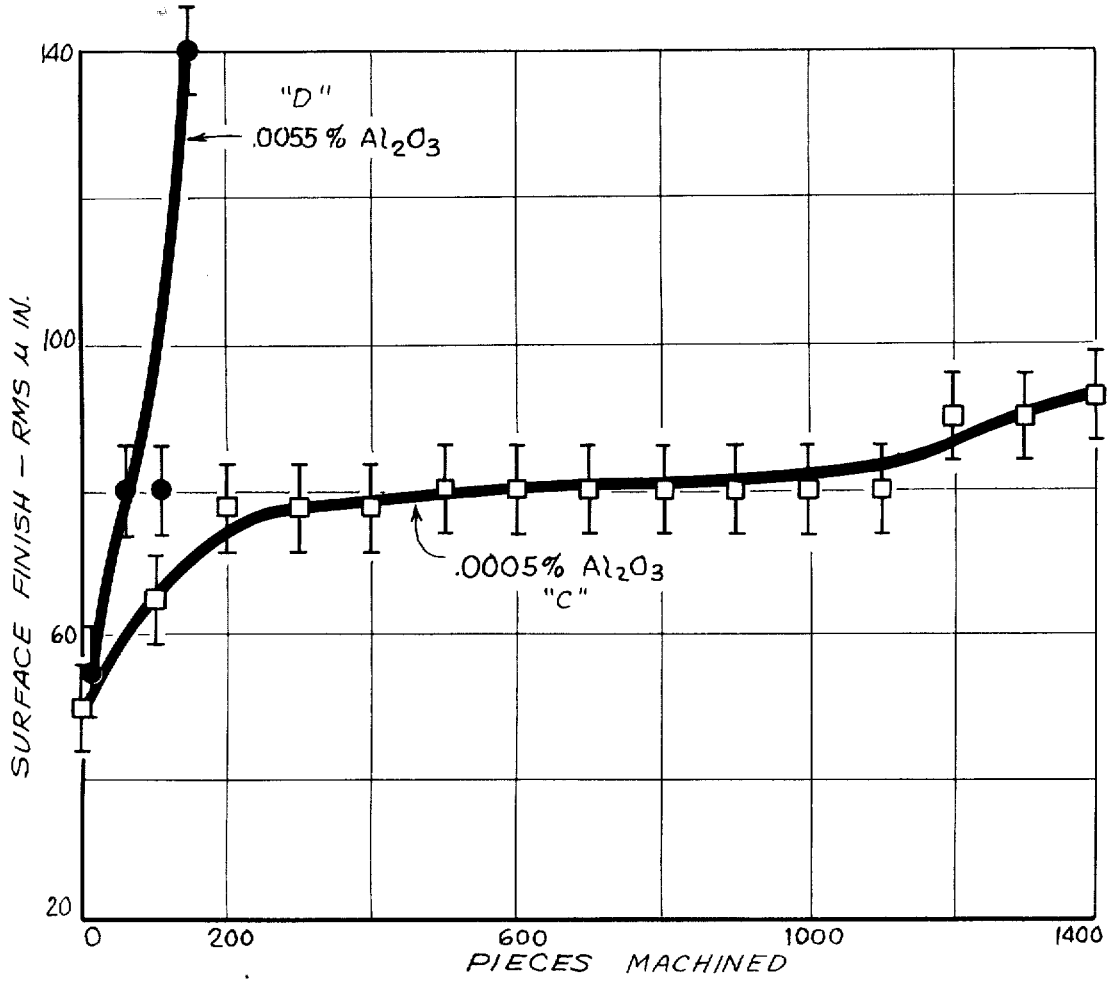
FIG. 11 is a graph of the results of screw machine tests of stainless steels, showing the effect of aluminum oxide in the steel.

FIG. 11 shows the results of 8-hour screw machine tests on speicmens from two heats of steel which are respectively designated as C and D, both being stainless grades of type 416 having manganese sulfide inclusions and manganese-sulfur ratios respectively of 2.9 and 3.2, i.e., within the range presumably resquisite for useful machining. The compositions were, approximately, 0.13% C, 1.1% Mn, 13% Cr, other elements within A.I.S.I. maximum limits for this grade, S respectively 0.38 and 0.33%, and no Se or Te. In FIG. 11, the surface finish is plotted against the produced number of pieces, for these two steel specimens. Heat C maintained a fairly level surface finish throughout about 1,500 pieces at 180 sfpm (surface feet per minute) whereas the roughness of the machined surfaces from the bars of heat D rose to a very high value at 175 pieces at 162 sfpm, indeed virtually destroying the tool. On chemical examination, heat C contained only 0.0005% aluminum oxide, while heat D was analyzed to have 0.0055%. In special single-point-turning, dry tool life tests, designedly abbreviated by using no cutting fluid, like results of markedly longer tool life on the low-alumina metal C were obtained, by a factor of several times the tool life on metal D.

Figure 12:
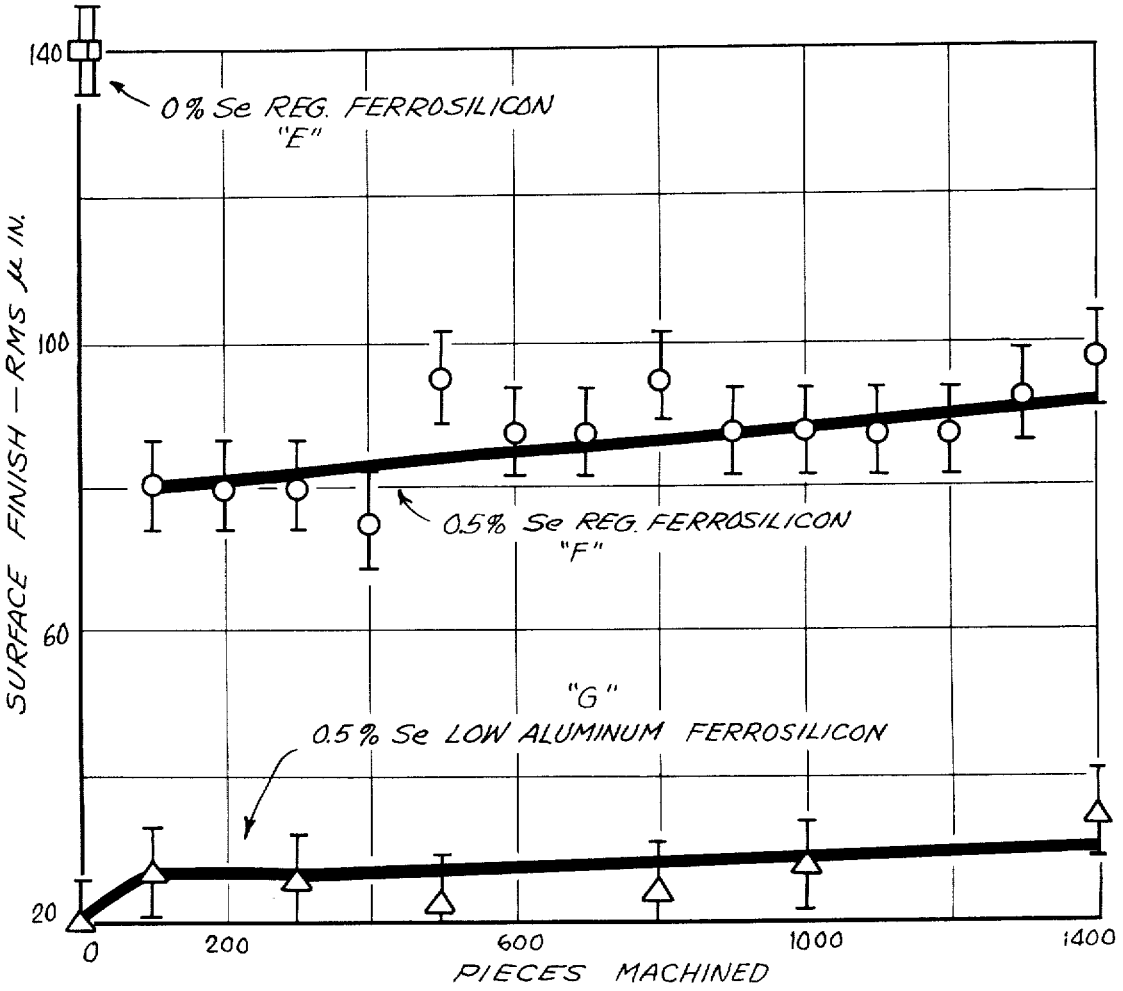
FIG. 12 is a graph of the results of screw machine tests, comparatively showing the effect of aluminum oxide in stainless steel without and with selenium in accordance with the invention, and in stainless steel produced in accordance with a further feature of the invention.

Further significant results are shown in FIG. 12 where a series of heats of 416 types stainless steel having the same kind of basic composition as heats C and D are shown as subjected to the automatic screw machine test, being respectively as follows:

11. A heat here designated E, having a manganese-sulfur ratio of 2.92, but containing no selenium addition and thus in no way embodying the present invention. In the production of this heat it was killed with ordinary ferrosilicon (75% Si, 1 to 2% Al), no effort being made to avoid aluminum as an impurity in the latter. The steel analyzed 0.004% $Al_2O_3$.

2. In a heat designated F, selenium was added, in amount of 0.05%, the manganese-sulfur ratio being still approximately 3, i.e., 3.12. The content of $Al_2O_3$ was 0.0038%.

3. A heat G, wherein selenium was also added in the same proportion, and the manganese-sulfur ratio was again about the same, being 2.92. However, in this instance the deoxidation was effected by adding a special grade of ferrosilicon containing very little aluminum, i.e., 75% Si, 0.5% Al max. Analysis showed only 0.0006% $Al_2O_3$.

As will be seen at once from FIG. 12, with the test run at a cutting speed of approximately 200 sfpm in all cases and cross slide feed of about one-seventh of an end slide feed of 0.0045 inches per revolution, there was essentially zero life of the finish forming tool for the steel of heat E. The surface roughness rose immediately to 140 microinches R.M.S. and the test was promptly interrupted. Although presumably a similar aluminum impurity occured in the steel of heat F, useful machining was obtained through a run of over 1,400 pieces, with surface finish consistently under 100 microinch roughness. Finally, with the very low aluminum content in the deoxidizing addition, heat G, unusual machining properties were obtained. A full run of 1,700 pieces was performed, maintaining surface finish with roughness well under 40 microinches R.M.S. throughout.

As will be noted, the provision of globular Mn(S, Se) inclusions in the tested steel bar stock of heats F and G by virtue of the selenium addition improved the machining properties in very marked degree, both as to tool life and surface finish. On comparison of the results for heats E and F with FIG. 11, it is also apparent that the improved composition and inclusion structure of heat F had substantial effect in counteracting or toward overcoming the adverse influence of the aluminum oxide particles. The test with the final heat, G, demonstrated impressively the result of reduction of alumina to a very low value, and also the improved, overall machining properties acheived by the specific sulfur-selenium type inclusions.

Figure 8:
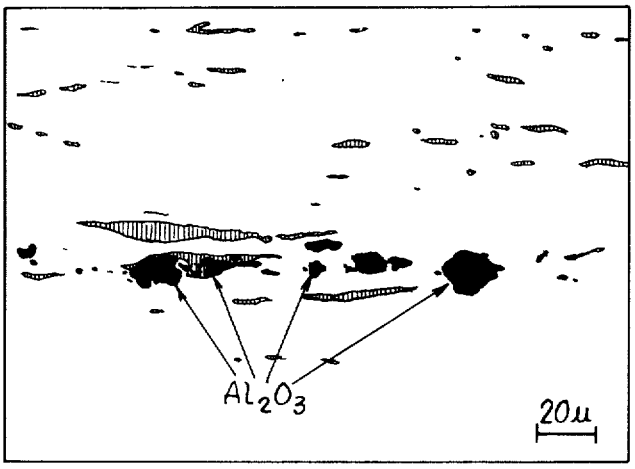
FIG. 8 is a microphotographic view, comparable with FIG. 4, showing aluminum oxide particles in a stainless steel.
Figure 9:
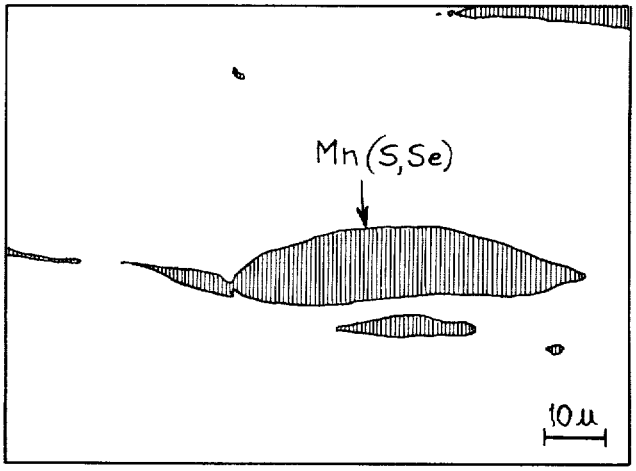
FIG. 9 is another view, on further magnified scale, of inclusions in an example of the invention.
Figure 10:
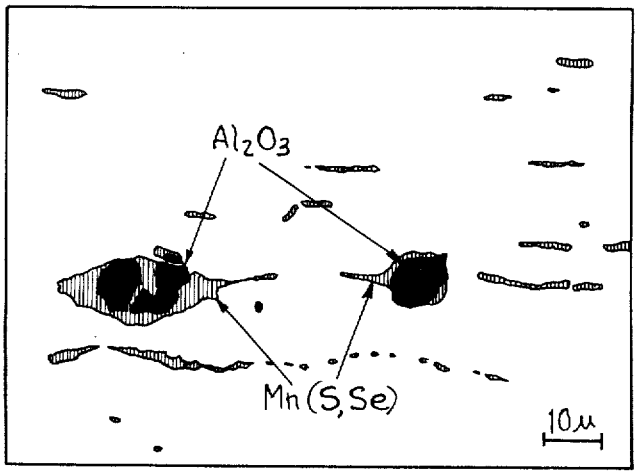
FIG. 10 is a view, to be compared with FIGS. 8 and 9, showing aluminum oxide particles in a stainless steel embodying certain features of the invention.

These results are confirmed by the microphotographic views of FIGS. 8, 9 and 10, FIG. 8 showing a steel such as heat E, with relatively imperfect sulfide inclusions, and large particles of aluminum oxide, being the very dark irregular masses. In FIG. 10, which shows a steel containing selenium but with no effort to reduce aluminum oxide— thus corresponding to heat F—the dark aluminum oxide particles are noted to have become incorporated with the sulfide-selenium inclusions, and indeed in part to be coated or covered by the material of such inclusions. Finally, FIG. 9 shows the highly desirable, alumina-free inclusions constituted by steel such as that of heat G or the specific examples of 416 and 303 (A and B for each) given above.

In general, it is found that the aluminum oxide in the finished billet of steel should not be more than 0.0025%, and indeed most advantageously and critically for best results, not more than 0.002%. Experience has also indicated that where ferrosilicon, containing 75% silicon by weight, is added for deoxidation, usually in amounts between 5 and 10 lbs. per ton, the aluminum content of this material, e.g., as impurity in it, should not exceed 0.5%, and preferably lower, even down to 0.1% if possible. The actual amount of ferrosilicon added for a given heat will, of course, depend on the amount of silicon already present, whether incidentally or otherwise, and available to coact with the ladle addition. As indicated below, other agents can be used instead of silicon. While in theory vacuum deoxidation should be appropriate, it has appeared to involve some difficulty because the preferred Mn(S, Se) inclusions apparently embrace some oxy-type combination of the elements for best effect and vacuum treatment depletes the available oxygen too much. It is nevertheless conceived that in some cases and with special control or other compensation, vacuum techniques may not necessarily be excluded.

It is particularly noted that although the total aluminum content of the steel should preferably be kept as low as possible, and indeed ordinarily at a level no greater than what would be considered as incidental impurity, the critical condition is related to explicity to aluminum oxide, conveniently analyzed as acid-insoluble aluminum and reported or calculated as the oxide. Indeed, it has appeared that stainless steels produced in accordance with the present invention and having alumina well below 0.002% may nevertheless have a total aluminum content somewhat higher than that accounted for by alumina inclusions, such excess aluminum being presumably alloyed in the steel matrix. In other words, small quantities of aluminum presumably present as metal and other acid-soluble form may be tolerated perhaps because they are dissolved in the melt in the beginning and do not participate in deoxidation reations to the extent of aluminum added in the furnace or later, but in any event it is important to minimize aluminum additions, even incidentally, which have oppurtunity for conversion to oxide.

By way of further evidence of the aluminum oxide effect, a group of 12 heats of 416 grade stainless steel, which contained selenium and thus involved the improved inclusion structure, and which were subjected to deoxidation with ferrosilicon of low aluminum content, were subjected to analysis for aluminum oxide and were also, in appropriate bar form, subjected to expedited tool life tests. The stainless steel of 9 of these heats showed aluminum oxide content ranging from 0.0009% to 0.0018% and afforded tool life by the above tests in the range from 170 to 418 seconds. In contrast, three of the heats showed alumina analysis of 0.0028 to 0.0031%, and a lower range of tool life, namely 77 to 116 seconds. The advantages of very low alumina content were thus further demonstrated, as well as the importance of critical control to assure production of the desired low-alimina metal.

A particularly effective procedure for producing stainless steel in accordance with the invention thus includes the steps of deoxidizing the metal, as in the ladle, by addition of silicon or other agent havnig no more than a very low aluminum content. In the case of ferrosilicon, containing 75% Si, this should be not more than 0.5% aluminum. More generally stated, it appears that the deoxidizing agent, of which other examples are rare earth elements such as lanthanum, cerium, and others, should not introduce more than about 0.003% aluminum, measured as weight percent of the steel, and preferably not more than 0.0025%. A further step in the production process is that each completed heat of steel is tested by analysis, for example ingot or billet form, to deterimine the aluminum oxide content, and the actual production of finished metal to constitute a truly machinable product is selected as those heats for which the analysis shows a content of alumina not greater than 0.002%. Thus were for some indeterminable reason an occasional heat may reveal a significantly higher alumina concentration, the product may be diverted to other uses, so that the controlling operation, as just explained, restricts production of the stated limit.

Analysis of the aluminum present may be achieved in any suitable fashion, i.e., in accordance with any of various available chemical and spectrographic procedures. One suitable mode of examination, for instance, has involved obtaining a quantity of chips of the steel, including fine particles, by milling or drillng, c.g., 10–15 grams. These are dissolved in suitable acid (hydrochloric and hydrofluoric) and filtered. The residue containing the acid insoluble aluminum may then be analyzed for such aluminum by appropriate spectographic technique. For instance, one convenient process involving fusing the residue in potassium pyrosulfate, and then dissolving the solidified fusion product in concentrated hydrochloric acid containing yttrium (dissolved therein as oxide) as internal spectographic standard. This solution was then utilized for analysis by emission spectrogrpahy with a rotating disk spectograph, the amount of aluminum being determined by a densitometer reading of the exposed and developed plate from the instrument. As stated, it is understood that chemical and like procedures suitable for determination of acid-insoluble aluminum, e.g., as aluminum oxide, are in effect known, although not heretofore routinely employed in steel making practice.

As also indicated, special advantage in machining operations, notably as to chip characteristics, was realized by subjecting the martensitic grade steels to a special heat treatment. More specifically, instead of the usual solution treatment of the hot-rolled product in the range of 1,800° to 1,850° F., followed by the usual quenching or air cooling and thereafter tempering, specimens of the 416 grade stainless steel (as of the composition in the examples above) were normalized by heating in the multiphase region between the upper and lower critical temperatures. This involved a heat treatment at normalizing temperatures, for steels of about 13% chromium, about 1.1 to 1.2% manganese, about 0.3% sulfur, and 0.05% to 0.1% selenium, which were in the range of 1600° to 1700° F. The steel was held at this normalizing temperature, e.g., 1700° F., for about 1 ½ hours for 1 inch diameter bars, then air cooled to room temperature or at least below 200° F., and thereafter tempered in conventional manner to a desired hardness.

Samples of various heats of steel treated in this manner showed considerable improvement in chip characteristics on machining, for example in tests of drilling utilizing ½ inch or 1 inch diameter drills at speeds of 300 rpm or above, with appropriate lubrication. Instead of long, ribbon-like chips, sometimes several feet in length, the chips tended to break off in much shorter and more manageable fashion.

A preferred treatment, which is believed to result in a microstructure of martensite and ferrite that is peculiarly appropriate for machining, involved first heating the steel, in rod or other finished stock shape after all hot rolling and any cold drawing that may have been used, to the lower critical temperature (which might be, for example, 1500°F.), and holding at that temperature for one hour or more. The temperature was then raised about 100° F. and again held for a predetermined time, for example 1 hour or more, being thereafter air cooled to a suitable low value, such as room temperature, or more gradually, below 200°F.

Again, the steel was tempered in conventional fashion, with attainment of hardness in the range commonly desired for martensitic stainless steel of these grades. The tempering treatment involved heating at temperatures conventionally appropriate, for instance in the range 1050° to 1100° F. for 1 ½ hours, then cooling to room temperature. There was no difficulty in attaining desired hardness by selection of tempering conditions in conventional manner, e.g. Brinell hardness values in the range of 195 to 250, preferably 195 to 220; nor was there difficulty in ultimately hardening machined products by standard procedure to satisfactory values such as Rockwell 40C to 45C.

Specific test results with this preferred treatment of type 416 steel, compositionally conforming to the present invention and produced to have the above-stated low content of aluminum oxide, showed even further improvement in chip characteristics on drilling tests, for a wide variety of compositions (whereas the simpler treatment was not as satisfactory for higher-manganese metal, e.g., over 1.5%, as on low-Mn steel) while other characteristics of machinability remained entirely satisfactory, i.e., at the levels of superiority described above.

By way of example, the following table sets forth the compositions of a number of steels which were subjected to the preferred type of heat treatment and which also serve to illustrate further compositional variations in this 416 grade, within the invention:

| Heat | C | Mn | P | S | Si | Ni | Cr | Mo | Cu | Se |
|---|---|---|---|---|---|---|---|---|---|---|
| H | 0.107 | 1.11 | 0.020 | 0.332 | 0.35 | 0.25 | 13.20 | 0.23 | 0.10 | 0.05 |
| I | 0.114 | 1.62 | 0.023 | 0.288 | 0.34 | 0.25 | 12.88 | 0.15 | 0.15 | 0.045 |
| J | 0.128 | 1.20 | 0.023 | 0.317 | 0.40 | 0.36 | 13.02 | 0.19 | 0.13 | 0.05 |
| K | 0.129 | 1.12 | 0.016 | 0.345 | 0.33 | 0.23 | 12.95 | 0.11 | 0.16 | 0.06 |

Drilling tests were performed on these steels in the above-described manner with ½ inch diameter drills operating under oil flood at a speed of 315 rpm and a feed of 0.00515 inch per revolution, and also with 1 inch drills at lower speed and feed. In all cases, the drill chips were considered good to excellent, being tightly curled, brittle pieces, for the most part relatively short. This was in distinction to the experience of like tests with steels of similar composition that had not received the special heat treatment. In the latter cases, the chips tended to be tough, whether long or short, and likewise to be open or almost straight, with very long chips tending to predominate.

It will also be understood that the upper and lower critical points vary with the composition of the steel, in accordance with recognized principles, determinations for particular cases being thus readily achieved from known data, or by tests if necessary. Thus the critical point values vary with composition, particularly manganese content in the martensitic grades of the 400 series. Both the lower and upper critical points fall with increase of manganese, the change in the lower critical temperature being considerably larger in proportion. For example, in 13% chromium stainless steels, the lower critical point ($A_1$) is in the range of 1560° to 1425°F. for 0.45 to 2.14% Mn, and the upper point ($A_3$), or complete austenitizing temperature, is in the range of 1775° to 1750°F. for the same Mn range.

As will be understood, the critical points, which define the range over which the structure of the steel undergoes change in the usual manner (being completely austenite above the upper point), are different for heating and cooling, being higher when attained in the course of heating. The critical points mentioned and exemplified above are those for heating, and brevity these points are simply identified as $A_1$ and $A_3$ without further qualifying designation.

In preferred practice of the present invention, as relating to martensitic stainless steels characterized by the defined Mn (S, Se) inclusions, the basic or simpler heat treatment involves a temperature well within the $A_1$–$A_3$ region, e.g. at least 50° F. above $A_1$ and 50° F. below $A_3$, and advantageously in a range departing by about 100° F. from each point, and where the two-stage operation is used, starting at $A_1$, the second step is preferably 100° F. to 150° F. above it. The time at each selected temperature, for either mode, is usually one hour or more, preferably 1 ½ hours for bars and the like, and longer times for heavier sections.

Advantage has been achieved by addition, to compositions embodying the improved Mn(S, Se) inclusion, of rare earth elements, in General any one or more of this known class in a specific, practical sense, combinations of lanthanum and cerium or a selection of one or more of the so-called cerium earths, notably lanthanum, cerium, and neodymium. Not only do such additions tend to promote formation of Type I sulfide inclusions at the expense of other types, but tests have revealed specific improvement in machinability for stainless steel compositions otherwise conforming to the invention. For example, selected ingots of the 416 heat designated H in the last previous table above, were subjected to addition (in the molten condition of the steel) of quantities of a commercial rare earth alloy called Lancelloy and consisting of metallic lanthanum and metallic cerium. The resulting steel products, along with steel from an untreated ingot, were subjected to machinability tests (after the usual hot rolling reduction), specifically a single point turning test as described above at 200 sfpm, yielding tool life determinations in seconds.

| Rare Earth Addition (Pounds per Ton) | Tool Life (Seconds) |
|---|---|
| 0 | 98 |
| 2 | 161 |
| 3 | 338 |

As will be noted, the rare earth metal additions in this selected case afforded an improvement in tool life of notable advantage especially in that tool life without the additions happened to be somewhat less than optimum. Separate tests indicated that this heat had excellent machined surface finish characteristics, which were not significantly affected by the rare earth additions. Some tests on steel of another specific composition tended to indicate that machinability improvement with rare earth metals may involve some correlation between the amount of such addition and the content of sulfur, or sulfur and selenium, in the steel. For instance, with a lower sulfur content than in the above heat, tool life improvement was selectively noted for an addition of 2 lbs. rather than 3 lbs. of the rare earth alloy per ton. There was also indication, in further tests, that with a larger content of manganese, machinability advantage with rare earth elements may be less.

It was further noted from microprobe examinations of certain of these steels that some inclusions appeared, of parts of the sulfide-selenide inclusions, where lanthanum and cerium tended to concentrate in association with silicon and oxygen to the exclusion of manganese and sulfur. Inclusion bodies of this type presumably embraced oxides or oxygen-containing compounds of the rare earths, but represented only a very minor fraction of the total inclusion volume and at least for such reason appeared not to affect the machining properties adversely. In general, the rare earth additions tended to be beneficial, especially in heats with manganese content below, for example, 1.4%.

A notable utility of the rare earth additions is that they may serve to effect deoxidation, e.g. in lieu of other agents such as silicon or in combination with the latter. Thus the procedure of making stainless steel, of any of the various grades contemplated by the invention, may include the step of supplying rare earth metals, in suitable metallic form as above, to the melt at the time of pouring, for instance in the ladle in appropriate amount, as of the order of 2 to 4 lbs. per ton. For the beneficial effect of lanthanum, cerium or the like in the inclusions, of the present indication is that the rare earth content is in the range of 0.02 to 0.3%, preferably 0.05 to 0.2%, the above additions to heat H, measured as 2 and 3 pounds per ton, being equivalent to about 0.1 and 0.15%, respectively.

Although the several features of the invention have been chiefly exemplified above with respect to the martensitic grade 416, they have been demonstrated to be effective in other grades to which they are applicable.

Thus the improved nature of the Mn(S, Se) inclusions has been achieved in the austenitic grade 303, and likewise the controlled limitation of aluminum oxide to very low values, the procedure and resulting compositions, being essentially identical in each case for this other free-machining type, namely as to content of S and Se and as to maintenance of alumina below 0.002%, preferably well below. All of this has been demonstrated with excellent results on the 8-hour screw machine tests, in a number of other 70-ton heats of type 303, additionally to those designated A and B above. In these heats, the compositions ranged approximately as follows: 0.07 to 0.12% C (mostly below 0.1%), 1.6 to 1.9% Mn, 0.025 to 0.04% P, 0.26 to 0.35% S (mostly above 0.3%, 0.3 to 0.7% Si, 0.15 to 0.35% Cu, 9.05 to 9.5% Ni, 17.0 to 18.2% Cr, 0.22 to 0.58% Mo, and 0.04 to 0.08% Se, with $Al_2O_3$ below 0.002% in the several instances where it was controlled.

It has also been demonstrated, by a number of examples, that other stainless steels are susceptible of improvement in machining properties in accordance with the principles of the invention. In the case of grades heretofore considered to be free-machining, such as A.I.S.I. 430-F, which is ferritic steel of straight-chromium type with chromium 14–18% (usually about 17%), the composition as to sulfur, selenium or tellurium and low content of aluminum oxide may be the same as for martensitic grade 416. Some tests of Type 430-F compositionally modified in this manner have indicated that the desired inclusions were present and have shown marked improvement in various aspects of machinability, comparable to results with Type 416. Where other grades of the 400 series have previously been designed to be machinable, as with sulfur additions, it is conceived that similar compositional features are appropriate, examples of such grades being 420F (like 416, but with higher carbon) and 440F (chromium 16–18%, carbon about 1%), these being both martensitic and also susceptible of improvement by the special heat treatment described above.

In other cases, it is sometimes desirable to improve machinability, even though the ultimate uses of the steel do not permit the magnitude of sulfur and other additions which would afford machining properties that approach grades such as 303 and 416. Thus for example the following represent analyses of heats of grades 304 and 316 to which were added an amount of selenium designed to afford Mn(S, Se) inclusions of the desired type as described above, in coaction with the low amount of sulfur tolerated in such steels:

| HEAT | C | Mn | P | S | Si | Cu | Ni | Cr | Mo | Se |
|---|---|---|---|---|---|---|---|---|---|---|
| GRADE | | | | | | | | | | |
| L - 304 | 0.078 | 1.81 | 0.031 | 0.028 | 0.53 | 0.10 | 8.95 | 18.35 | 0.38 | 0.03 |
| M - 316 | 0.058 | 1.85 | 0.028 | 0.029 | 0.45 | 0.26 | 13.30 | 17.48 | 2.16 | 0.016 |

Machinability tests of these heats designated L and M showed that the properties were appreciably improved over those of ordinary heats of the standard compositions. The aluminum oxide content was, in each case, controlled to fall below 0.002%, but since these are austenitic steels, the special heat treatment was not employed. As will be understood, these grades are intended to have high corrosion resistance (very high, in the case of 316), thus limiting the amount of sulfur that might be included. Type 304 is also expected to be capable of highly polished or bright surface characteristics for decorative purposes.

It should be noted that in the situation of these and other types where the level of sulfur and selenium is relatively low and the volume ratio of inclusions is correspondingly low, e.g. from 0.1 to 0.5%, vacuum deoxidation techniques have been indicated to be suitable. To some extent in very low sulfur grades, such as the basic 12-chrome grade 410, it may be permitted to increase the sulfur content somewhat, in accompaniment to the Se additions, e.g. possible to 0.05% S with 0.02 to 0.03% or more Se.

Improvement has also been noted, by test, for grade 203 (17% chromium, 6% nickel, 6% manganese) with compositional characteristics in accordance with the invention. Indeed with sulfur content in this type of stainless steel at levels of 0.2 to 0.35%, selenium additions in the range of 0.02 and preferably upward have been effected, yielding the desired type of inclusions and a volume fractions of inclusions, for example 0.5 to 1%, approaching the situation of the improved 303 grade, with corresponding enhancement of machinability.

Still another type of stainless steel for which some tests of the invention have been made is the so-called 17-4 precipitation hardenable steel, as for example 0.045% C, 3.4% Cu, 4% Ni, 16% Cr. In this instance limited addition of selenium, where sulfur content was around 0.01 to 0.02%, afforded modest improvement, while in situations where the sulfur content was allowed to rise to 0.15% and above, correspondingly larger amounts of selenium, e.g., 0.03 to 0.1% were employed with significant advantage in the machining properties.

In all of these cases it will be understood that the control of alumina to low values is readily applicable with corresponding advantage. Such feature cannot, of course, be employed in special types which require a significant aluminum content, such as grade 405 and the semi-austenitic grades of precipitation hardenable steels. In the case of the stainless grades of martensitic character that are to be precipitation hardened, such as 17-4 and 15-5, the special heat treatment can be employed, i.e., in substitution for a conventional treatment, without substantial detriment to the ultimate precipitation hardening which thereafter involves heating at 900° F. or higher, and air quenching, and which is performed on the finished piece after all machining and forming.

Figure 13:
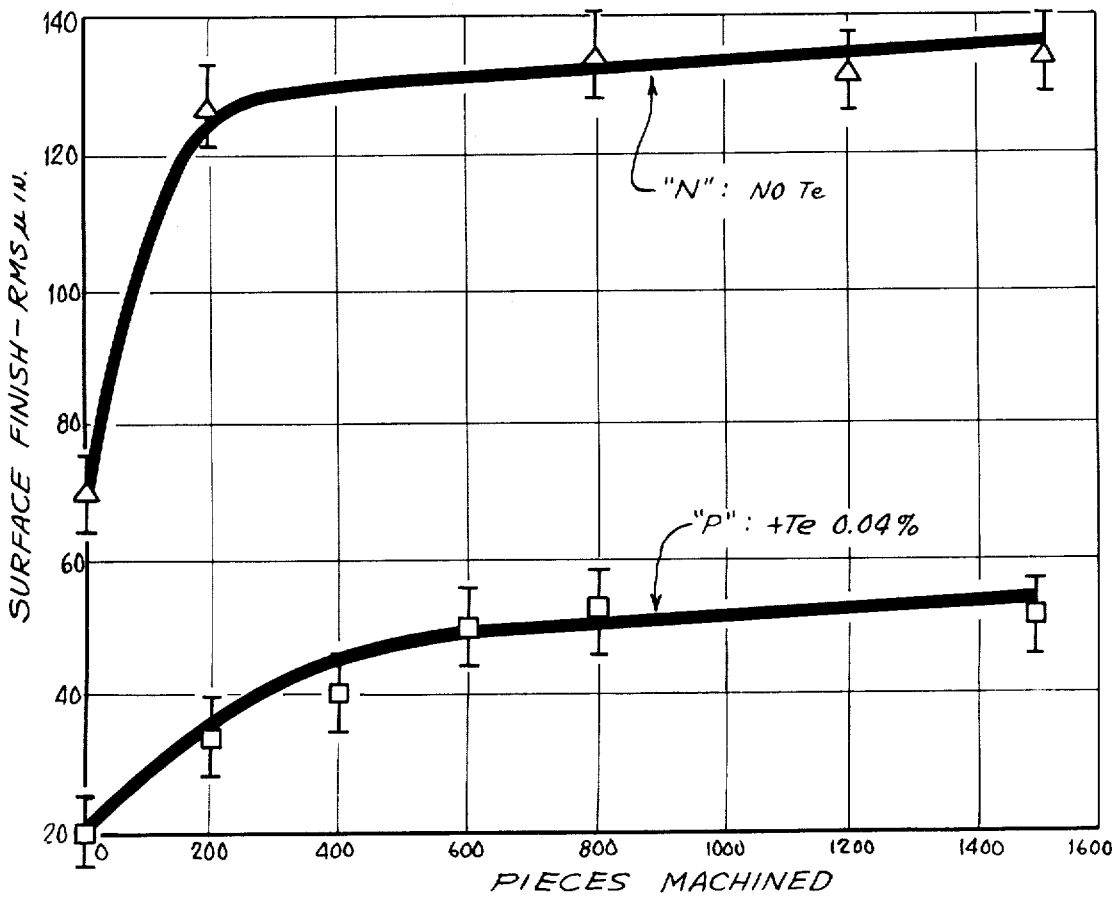
FIG. 13 is a graph of the results of screw machine tests, showing the effect of tellurium addition in accordance with the invention.

FIG. 13 shows the results of an 8-hour screw machine test for stainless steel of the 416 grade, utilizing tellurium instead of selenium. The composition was essentially similar to several 416 heats above, having about 0.11% C, 1.1% Mn, 12.6% Cr, and with sulfur about 0.35%, Te 0.04%, and no Se. The uppermost curve N in the figure is that for a complete test with steel from an ingot of such heat which did not have the Te addition, while the lower curve P represents an ingot in which the tellurium addition was made, both tests being performed at 180 sfpm for a full run of 1500 pieces. The comparison pieces N showed a relatively high surface roughness, rising early in the run to a rather high value (in RMS microinches), also indicating a considerable tool wear. In contrast, Te-containing specimens were found to machine to a significantly smoother surface finish (roughness less, of the order of one-half), e.g. as indicated by curve P. It appears that tellurium can be used instead of Se, for like effect and in essentially the same amounts, although (as indicated above) some special advantage has been indicated for selenium, including the fact that with Te additions of 0.04% and upwards the steel is likely to require higher hot rolling temperature, 2000° F. and above.

In carrying out the invention, usual steel making practices can be followed, as may be appropriate for the selected stainless grade, including conventional electric or other furnace techniques and conventional modes of incorporating the usual ingredients and thereafter pouring ingots and reducing the steel by hot rolling or other hot working to the desired final shape. In the case of round bar and similar products, cold drawing may be performed as final stage affording an ultimate, small percentage of reduction, for the usual reasons. In all cases, the compositions are modified as described herein including the addition of selenium or tellurium to the melt in the ladle or ingot mold, conveniently as a ferro-alloy usually containing about 50% of the desired element. Control is advantageously exerted over the aluminum oxide content in the manner described, including use of appropriate, special deoxidation procedure. Finally, for the martensitic grades the special heat treatment is preferably performed in an inert furnace atmosphere, for example of a sort suitable for other heat treatments of stainless steel.

The results of the invention in respect to machinability are unusually good, especially in grades cush as 303 and 416. As will be understood, the inclusions appear to function very effectively, and indeed appear to satisfy very well two specific aspects of their function, namely that in machining operations the inclusions produce microcracks in the shear zone, thus promoting local fracture and reducing the energy consumed, and further, that the inclusion material deposits on the tool surface, in very small amounts, thus reducing tool wear. The attainment of these results as to machinability has been thoroughly established with the 8-hour screw machine tests and indeed with such tests of the several major features, notably in the case of grades 303 and 416, as embodied or carried out in large-scale heats, e.g. regular 70-ton electric furnace heats.

It has been specifically found that whereas preliminary and sometimes confirming tests with laboratory size heats, i.e., of the order of 100 lbs., are necessary and advantageous, information about inclusions of this sort in laboratory heats is apt to be misleading or inconclusive. With very small ingots, cooling effects, solution effects, dendrite spacing, convection currents, and other factors related to solidification are apt to be quite different from large ingots of the order of 2 tons or more, which cool very slowly. In this connection, it must be remembered that these inclusions are formed and their characteristics as to shape and nature are determined during and at the end of solidification so the inclusion structure or morphology is essentially only predictable for actual production heats by making tests with heats of such magnitude.

In a broad sense, stainless steels here contemplated include such as may contain 10–27% chromium and 0 to 22% nickel. The so-called straight-chronium grades (e.g. up to 27% Cr) usually have less than 3% Ni or in most cases substantially less than 1%, e.g. as in type 416, which has 12–14; % Cr. in general, the chromium-nickel grades may contain 14–26% Cr and 4–22% Ni with many types, among, the 300 series, characterized by 15–21% Cr and 6–15% Ni, the nickel content being 8–13% for certain more common austenitic types. Thus grade 303 is specified as 17–19% Cr and 8–10% Ni.

While the manganese can range from 0.3 to 10% in stainless steels, a preferred minimum for the invention is 0.8%, with special advantage, in the free-machining grades, at 1% or more and in some instances, notably the austenitic series, 1.5% or above; not more than 3% is necessary in many cases, and indeed preferably not more than 2%, or advantageously less.

Optional or incidental elements in stanless steels (conceived to be tolerable in broader applications of the invention) may include up to 4% molybdenum, though usually below 1% in the machining grades, up to 5% copper when desired, and up to 1.5 silicon, but preferably not over 1% Si. Total additions of minor, special-purpose elements up to 2% (e.g. up to 1.5 of any one) are conceivable for instance such as Ti, Cb, Ta, Co and Zr. In all cases, of course, the balance of the composition is iron (e.g. at least 50%) and incidental impurities, togther with carbon 0.01 to 1.2%, more usually 0.05 to 0.2%. All percentages herein are by weight, except in reference to the volume content of inclusions.

While sulfur can range from 0.01 to 0,7%, it is more often at least 0.02% and advantageously not above 0.5%. For machining grades a minumum is 0.15%, but for best results with the invention, at least 0.2% and notably 0.3%, e.g. in the range of 0.45% or conveniently not more than 0.4%. While in a broad sense the material of the selenium and tellurium class can range up to 0.3%, or with further cost, to 0.4%, there is special advantage in the economical lower ranges noted earlier above. Indeed some drill penetration-time tests have indicated little, if any, advantage in that specific respect, in carrying selenium to as much as 0.15%, or indeed much over 0.1%. The content of this addition is preferably 0.02% or above, or advantageously at least 0.03%, to approach special machinability as evidenced by volume fraction of inclusions. Such inclusion volume content is advantageously 0.2% and preferably 0.3%, or more, a minimum of 0.5% by volume being greatly preferred to acheive a machining-type steel. Maintenance of an element such as selenium at the lowest weight-percent level consistant with optimum results is specially desirable, in tht such element, in excess, may tend to have a harmful effect on surface properties of stainless steel.

Expecially in preferred embodiments, the invention afford notable improvement in machinability, attributed in significant part to the content of relatively large globular inclusions, which are substantially free of iron and chromium and which are understood to consist essentially, or at least predominantly, of the nature of the sulfides, selenides and tellurides of manganese, such terms being employed to include so-called oxy compounds, e.g. oxysulfide. It appears, for example, that Mn (S, Se) inclusions have a higher melting point than MnS bodies, and thus can form properly before complete solidification of the steel, and indeed selenium, of itself, appears to form only globular type inclusions.

The practical results have been abundantly demonstrated by the screw machine tests, where the automatic machine runs continuously for 8 hours, with the cutting tools repeatedly used in conventional manner, i.e., in the automatically repeated sets of machining operations. Very satisfactory tool life (8-hours or more of such machine run) and excellent surface finish are attained for the machining grades of these steels, at surface speeds up to at least 200 feet per minute. Whereas surface finish is recognized as conventionally better at high speeds, the great difficulty, that has now been overcome, has been that excessive tool wear and relatively short tool life have heretofore usually prevented the attainment of such speeds in machining stainless steel.

I claim:

1. In a method of making stainless steel which comprises producing, in molten state, a stainless steel melt which consists essentially of 0.01 to 1.2% carbon, 10 to 27% chromium, 0 to 22% nickel, 0.3 to 10% manganese, and further elements as specified in the following procedure, balance iron and incidental impurities, and solidifying said molten stainless steel, the procedure for producing said stainless steel to have improved machinability, which consists in incorporating into the molten steel of said melt at the end of its being produced:

1. amounts of sulfur and of an element or elements selected from the class consisting of selenium and tellurium for establishing in the solidified steel a content of 0.15 to 0.7% sulfur and a total of 0.03 to less than 0.15% of said selected element or elements, to produce in said solidified steel a distribution of globular inclusions which are predominantly provided by manganese, sulfur, and said selected element or elements; and
2. deoxidizing-agent-containing material for deoxidizing the molten steel of said melt, the deoxidizing agent or agents of said material being an element or elements selected from the group consisting of silicon and the rare earth elements;

said material being characterized by absence of aluminum in that the maximum content thereof is an amount that would add 0.003% aluminum to the melt and said melt being maintained substantially free of aluminum oxide, whereby the solidified steel is produced to have less than 0.0025% aluminum oxide.

2. A method as defined in claim 1, which includes testing the solidified steel for content of aluminum oxide, to limit the steel product having improved machinability to steel which contains less than 0.0025% aluminum oxide.

3. A method as defined in claim 1, in which said material consists essentially of ferrosilicon.

4. A method as defined in claim 3, in which said material is ferrosilicon containing about 75% Si and not more than 0.5% Al, said ferrosilicon being added in amount of 5 to 10 lbs. per ton of steel.

5. A method as defined in claim 3 in which the amount of aluminum in said melt is limited to produce the steel with not more than 0.002% aluminum oxide, said method including testing the solidified steel for content of aluminum oxide, to limit the steel product having improved machinability to steel which contains not more than 0.002% aluminum oxide.

6. A method as defined in claim 1, in which said material is a composition of rare earth elements which consists predominantly of lanthanum and cerium and which is characterized by absence of aluminum above an amount that would add 0.0025% aluminum to the melt, said solidified steel being produced to have not more than 0.002% aluminum oxide.

7. A method as defined in claim 1, in which said material is characterized by absence of aluminum above an amount that would add 0.0025% aluminum to the melt, and said solidified steel is produced to have not more than 0.002% aluminum oxide.

8. A method as defined in claim 7, in which said material consists essentially of ferrosilicon.

9. A method as defined in claim 7, which includes testing the solidified steel for content of aluminum oxide, to limit the steel product having improved machinability to steel which contains not more than 0.002% aluminum oxide.

10. Procedure utilizing the method defined in claim 1, which comprises: effecting continuing production by making successive heats of stainless steel, each being a melt produced and solidified in accorcance with said defined method of said claim 1 for the purpose of producing machinable stainless steel which contains said globular inclusions and has been deoxidized and which has less than 0.0025% aluminum oxide; testing the solidified steel of each melt for content of aluminum oxide; and obtaining said continuing production of steel products having improved machinability, by selection of solidified steel which contains, in accordance with said testing for each melt, less than 0.0025% aluminum oxide.

* * * * *